US008382313B2

(12) United States Patent
Fok

(10) Patent No.: US 8,382,313 B2
(45) Date of Patent: Feb. 26, 2013

(54) ELECTRIC TORCH

(76) Inventor: Shek Hung Fok, Kowloon (HK)

( * ) Notice: Subject to any disclaimer, the term of this patent is extended or adjusted under 35 U.S.C. 154(b) by 339 days.

(21) Appl. No.: 12/857,495

(22) Filed: Aug. 16, 2010

(65) Prior Publication Data

US 2011/0128724 A1 Jun. 2, 2011

(30) Foreign Application Priority Data

Nov. 27, 2009 (CN) ..... 2009 2 0315981 U
Nov. 27, 2009 (CN) ..... 2009 2 0315988 U

(51) Int. Cl.
*F21L 4/04* (2006.01)

(52) U.S. Cl. ..... 362/206; 362/183; 362/205

(58) Field of Classification Search ..... 362/183, 362/202, 204, 205, 206, 208
See application file for complete search history.

(56) References Cited

U.S. PATENT DOCUMENTS

| | | | | |
|---|---|---|---|---|
| 2,677,022 | A * | 4/1954 | Fleming | 362/206 |
| 3,219,811 | A * | 11/1965 | Young | 362/158 |
| 6,722,772 | B2 * | 4/2004 | Maglica | 362/208 |
| 2007/0058364 | A1 * | 3/2007 | Britt | 362/183 |
| 2007/0258236 | A1 * | 11/2007 | Miller | 362/205 |

* cited by examiner

*Primary Examiner* — Y My Quach Lee

(57) ABSTRACT

An electric torch (10) includes a main body (1), a head assembly (2), and a rear assembly (3) releasably engaged with a rear end of the main body. The rear assembly includes a rear cover (31) for enclosing an electrically conductive spring (315), an electrically conductive cathode plate (314), and a magnetic controlled member (313, 318) therein. The spring is electrically engaged between negative terminal (152) of the battery pack and the cathode plate. The magnetic controlled member is disposed between the cathode plate and rear end of the rear cover, and can divert electric current flows in the torch under an attractive force of a magnet. The main body and the rear cover are electrically conductive, and given an electrically nonconductive surface treatment except for certain areas (11-13, 3111-3112, 3121, 3121', 3122) for electrically connection. The torch is waterproof and multifunctional.

17 Claims, 7 Drawing Sheets

ELECTRIC TORCH

BACKGROUND OF THE INVENTION

The present invention relates to an electric torch or flashlight, and especially to an electric torch readily switching electrically current control circuit, presenting good waterproof, and being suitable for use by emergency workers.

An electric torch is one daily article for lighting. Particularly when power cut takes place in house, no power is supplied to outside at night, or the army or the police work at night, the electric torch is a necessary tool for lighting. Usually, only one switch as a turnable knob is set about a longitudinal axis of a main body of the torch, or mounted on the rearward end portion of the body for enabling a user to turn the flashlight on or off in a user selected one of intermittent operation and continuous operation. However, such switch is not always convenient or enough if the torch is mounted in a seat or rack. For instance, the torch is attached to a gun, or is worn by the user on the arm or head; therefore, an additional outer switch is necessary for the user to easily control by his finger. Moreover, a charger is always necessary for recharging the torch. Thus the electrically current control circuit of the torch needs to change between inner and outer switches or charger. There are some kinds of torches in the art comprising a tail plug at a rear end for electrical connection with an outer switch or a charger, but which will result in poor waterproof of the torch and even undesirably or wrongly lighting in water. Furthermore, the traditional torch is only used for lighting, and its function is very simple.

Therefore, an improved electric torch is desired which overcomes the disadvantages of the prior art.

BRIEF SUMMARY OF THE INVENTION

A main object of the present invention is to provide a multifunctional electric torch, which can easily and reliably switch electrical current flow, and present good waterproof.

Another object of the present invention is to provide an electric torch, which can be recharged or be used as a power supply to recharge other equipment.

A further object of the present invention is to provide an electric torch, which is suitable for use by emergency workers.

To obtain the above object, an electric torch in the present invention comprises a main body accommodating battery pack therein, a head assembly having a bulb with two terminals extending therefrom; and a rear assembly releasably engaged with a rear end of the main body. The rear assembly comprises a rear cover for enclosing an electrically conductive spring, an electrically conductive cathode plate, and a magnetic controlled member therein. The spring is electrically engaged between negative terminal of the battery pack and the cathode plate. The magnetic controlled member is disposed between the cathode plate and rear end of the rear cover, which can divert electric current flows in the torch under an attractive force of a magnet. The main body and the rear cover are electrically conductive, and given an electrically nonconductive surface treatment except for certain areas for electrically connection.

Preferably, the rear cover comprises a barrel and a tail block with being electrically insulative therebetween. The rear assembly further comprises a nonconductive ring. The spring, the cathode plate, the magnetic controlled member, the ring and the tail block are respectively co-axially assembled together and accommodated in the barrel with the tail block partially projecting rearward from rear end of the barrel. The ring is inserted between the cathode plate and the tail block, which defines a passage for receiving the magnetic controlled member therein.

The tail block substantially has a shape of cone with tip thereof extending from rear end of the barrel.

In a preferable embodiment, the magnetic controlled member is a metal slider with nonconductive surface treatment except for certain areas for electrically connection. The tail block is hollow in center and accommodating a spring therein so as to guide the slider moving therein. The slider is hollow in center therein for receiving an extending rod of the cathode plate. The electrically conducting spring is engaged with the cathode plate opposite to the rod. Therefore, when an attractive force from a magnet draws the slider moving to the tail block, an electrical bridge connection between the cathode plate and the tail block is available through the slider.

In another preferable embodiment, the magnetic controlled member is a magnetic contactor, which comprises a pair of contacts: stationary contact and a movable contact. The pair of contacts is respectively electrically connected with the tail block and the cathode plate through wires. Therefore, when an attractive force from a magnet draws the movable contact closed to the stationary contact, an electrical bridge connection between the cathode plate and the tail block is available through the contactor.

Preferably, the electric torch further comprises a magnetic control means removably and electrically coupled to the rear assembly of the torch. The magnetic control means comprises a rear magnet with electrically conductive surfaces, an end cap, an electrically conducting ring, and an out switch. The electrically conducting ring and the rear magnet are fixed in the end cap with electrical insulation therebetween. The rear magnet is electrically coupled to the projecting part of the tail block of the rear cover. The outer switch is respectively and electrically connected with the rear magnet and the electrically conducting ring with wires. Thereby an attractive force is exerted to the magnetic controlled member to obtain an electrical bridge connection between the cathode plate and the tail block.

Preferably, the head assembly further comprises a positive connecting means for electrically connecting or disconnecting between positive terminal of the battery pack and the bulb. The positive connecting means comprises a back plate, a socket, a metal shaft, a metal connecting post, and a current diverting means to divert electrical current in the head assembly. The back plate and the socket are electrically insulating and parallel mounted in head portion of the barrel. The metal shaft is inserted through the back plate with one end electrically connecting with the diverting means and the other end extending to electrically connect with positive terminal of the battery pack. The metal connecting post is mounted in the socket with one end thereof electrically connected with the terminal of the bulb. The diverting means is electrically connected with both the metal shaft and the other end of the connecting post in first position, and diverted to electrically connect with both the metal shaft and the main body under an attractive force of a magnet in a second position.

In a preferable embodiment, the diverting means is a movable metal arm, which is pivotally fixed on the back plate by the metal shaft. A spring is mounted on the back plate with one end grasping the movable metal arm to electrically contact with the metal connecting post in the first position. Therefore, electric current flows from positive terminal of battery pack, to the metal shaft, the movable metal arm, the metal connecting post, and then to the bulb. When a magnet draws the movable arm to leave the connecting post and electrically contact with main body, the electric current will be diverted to flow from the metal arm to the main body instead to the connecting post and the bulb in the second position.

In another preferable embodiment, the diverting means is a magnetic contactor, which comprises a stationary contact and a movable contact. The stationary contact is electrically connected with the main body by wire, and the movable contact is electrically connected with the shaft by wire. In the first position, the movable contact electrically touch the metal connecting post, which results that electric current flows from positive terminal of battery pack, to the metal shaft, the movable contact, the metal connecting post, and then to the bulb; and when a magnet draws the movable contact to leave the connecting post and get closed to the stationary contact, the electric current will be diverted to flow from the metal arm to the main body instead to the connecting post and the bulb in the second position.

Preferably, the electric torch further comprises a removable recharging rack which has two opposite seats: front seat and rear seat. The front seat has a front magnet coupled to the head assembly corresponding to the positive connecting means, and the rear seat has a rear magnet coupled to the rear assembly of the torch. Therefore, the electric current will be diverted to flow from positive terminal of battery pack, to the positive connecting means, the main body, the rear seat, and the rear assembly then back to negative terminal of battery pack and form an electric current for recharging. An adapter or a plug is connected with the rear seat by wires so that the recharging rack can be used to recharge the battery pack in the electric torch from an outer power supply; or another electric equipment is connected with the rear seat by wires so that the electric torch can be used as a power supply to recharge another electric equipment.

Other objects, advantages and novel features of the invention will become more apparent from the following detailed description of a preferred embodiment thereof when taken in conjunction with the accompanying drawings, wherein:

DETAILED DESCRIPTION OF THE INVENTION

Figure 4:
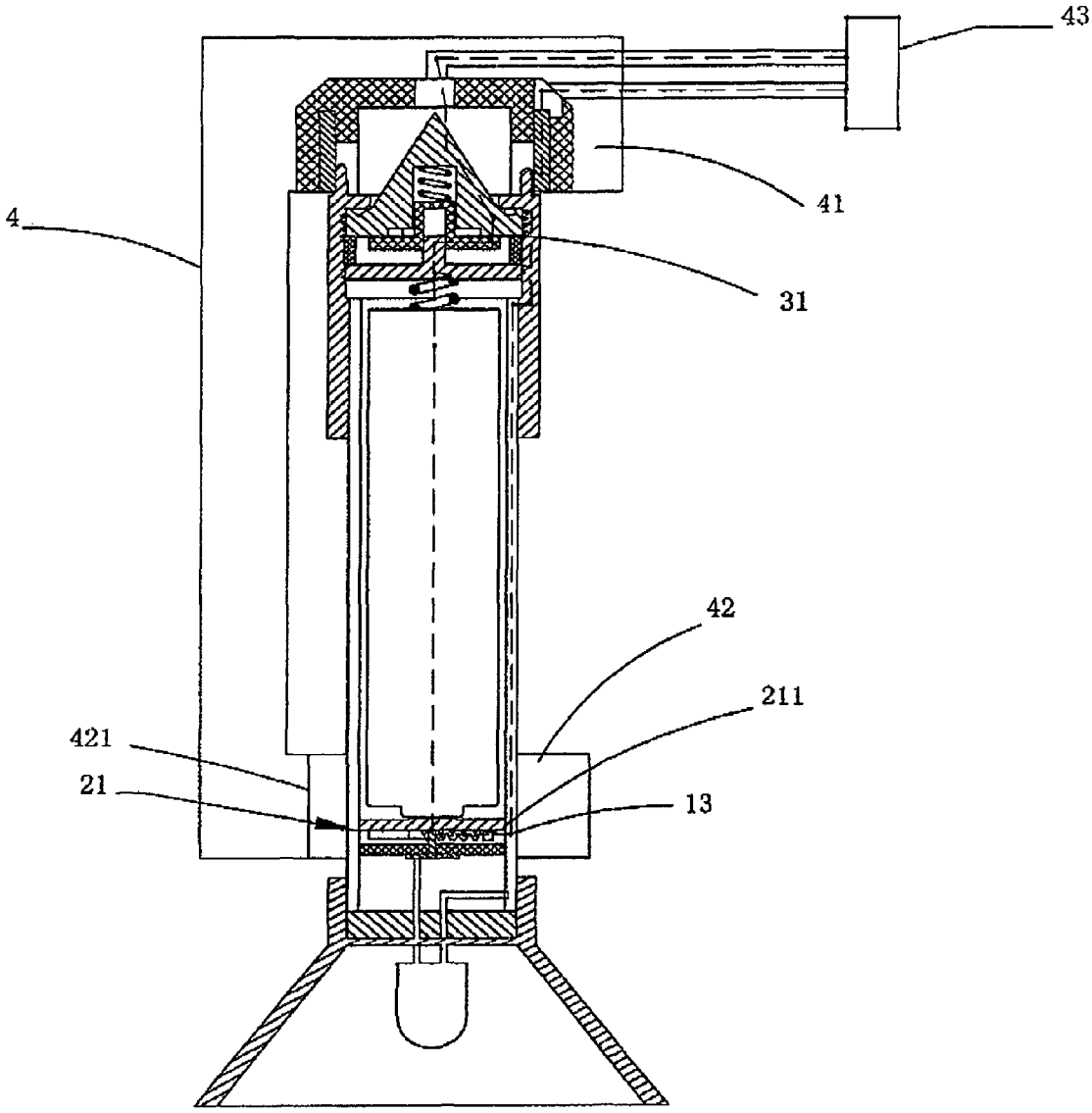
FIG. 4 is a sectional view of the electric torch in accordance with a third embodiment.

Referring to FIG. 1*a*, an electric torch 10 according to the embodiment of the present invention includes a tubular main body 1, a head assembly 2 and rear assembly 3. The main body 1 defines a compartment to accommodate battery pack 15 therein, and may be made from aluminum or other metal and given an electrically nonconductive surface treatment (e.g., black anodized). That results in the surfaces of the main body 1 being nonconductive except for certain areas 11, 12 and 13 (as shown in FIG. 4), in which the surface treatment is omitted (or removed as part of component fabrication), for electrically connection with the positive or negative terminals 151, 152 of battery pack 15.

The head assembly 2 comprises a bulb 22 locating at the focus of a reflecting concave of a reflector 23 with two electrically conductive terminals 221, 222 parallel and outwardly extending from the bulb 22. The two electrically conductive terminals 221, 222 respectively electrically connected with positive terminals 151 of battery pack 15 and the conductive area 12 of the main body 1.

Figure 2:
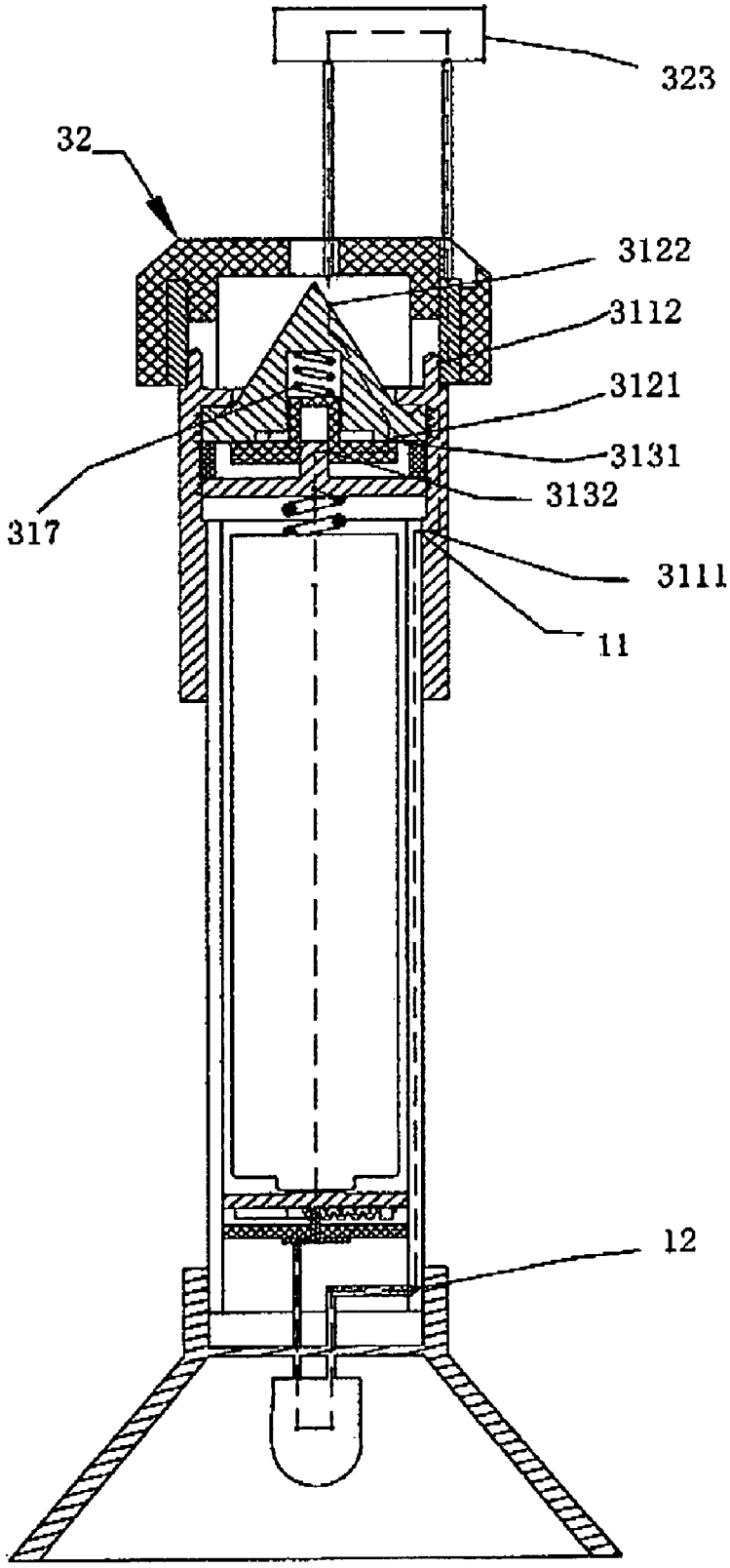
FIG. 2 is a sectional view of the electric torch in accordance with another embodiment.
Figure 3:
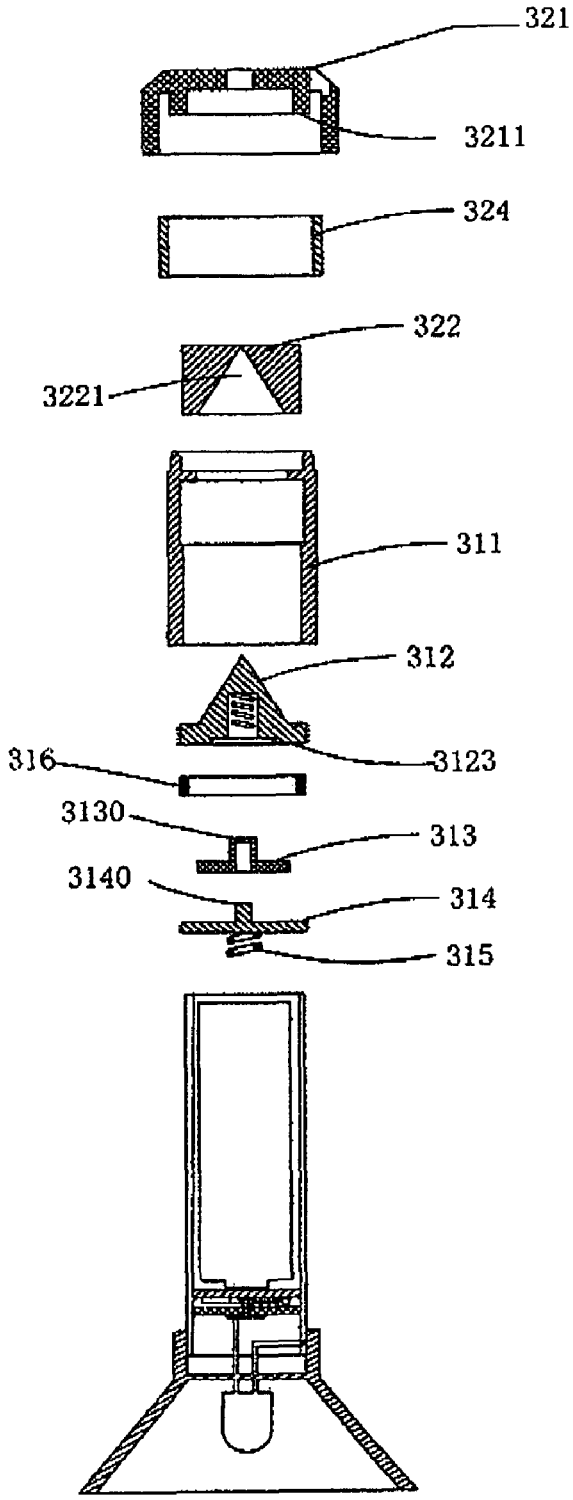
FIG. 3 is a partially exploded view of FIG. 2.

Referring to FIGS. 2 and 3 together, the rear assembly 3 includes a rear cover 31, a ring 316, a slider 313, a cathode plate 314, electrically conductive spring 315, all of which are co-axially assembled together and accommodated in the rear cover 31. The rear cover 31 comprises a tubular barrel 311 and a tail block 312, preferably keeping electrically insulative therebetween. In a preferably embodiment, the tail block 312 seals the rear end of the barrel 311 and partially projects from end of the barrel 311. The rear assembly 3 is releasably engaged with the rear end of the main body 1.

The tubular barrel 311 may be made from aluminum or other metal, and given an electrically nonconductive surface treatment. Thus the surface of the tubular barrel 311 is nonconductive except for certain areas 3111 and 3112 (shown as FIG. 2), in which the surface treatment is omitted or removed for electrically connecting.

The cathode plate 314 is electrically conductive, and substantially is a circular plate (but not limited to) with a guiding rod 3140 uprightly projecting from the center thereof. One end of the electrically conductive spring 315 is engaged at the center of the cathode plate 314 on the opposite face to the rod 3140.

The slider 313 substantially is a circular plate (but not limited to) with a guiding post 3130 uprightly extending from the center thereof, which constructs a reverse-T shape. The post 3130 is hollow therein for receiving the guiding rod 3140 of the cathode plate 314 therein. The slider 313 is preferably made from metal, and given an electrically nonconductive surface treatment. Thus the surface of the slider 313 is nonconductive except for certain areas 3131, 3132 (shown as FIG. 2), in which the surface treatment is omitted or removed for electrically connecting.

The tail block 312 is made from electrically conductive material, such as metal, and given an electrically nonconductive surface treatment. Thus the surface of the block 312 is nonconductive except for certain areas 3121, 3121', and 3122 (labeled in FIGS. 2 and 7), in which the surface treatment is omitted or removed for electrically connecting. In a preferable embodiment, the tail block 312 is in a shape like a cone, and the cone is hollow in the longitudinal center from bottom 3123 thereof, which is used to receive and guide the post 3130 of the slider 313 moving therein. A spring 317 is placed in the hollow center of the tail block 312 for holding the post 3130 of the slider 313. It is understood that the tail block 312 may be made from metal, thus keep electrically conducting on surface, and not given an electrically nonconductive surface treatment.

The ring 316 is not electrically conductive, and may be made from plastic. The ring 316 is located between the cathode plate 314 and the tail block 312, which defines a passage 3160 therebetween for receiving the metal slider 313 therein. The diameter of the circular slider 313 is relatively smaller than that of the bottom of the conic tail block 312, the ring 316, and the cathode plate 314.

When the rear assembly 3 is assembled to the main body 1, the electrically conductive spring 315 biases the cathode plate 314 rearward (i.e., away from the main body 1) while electrically connecting the cathode plate 314 with the negative terminal 152 of the battery pack 15. The slider 313 rests on the cathode plate 314 with the rod 3140 thereof extending into the hollow center of the slider 313. The plastic ring 316 is inserted between the tail block 312 and the cathode plate 314, which defines the passage 3160 for the slider 313 moving from the cathode plate 314 to the bottom 3123 of the tail block 312. The post 3130 of the slider 313 extends into the hollow center of the tail block 312. The spring 317 is engaged with the post 3130 in the hollow center of the tail block 312, so as to retain the slider 313 on the cathode plate 314. Finally, the tubular cover 311 sheathes and accommodates the co-axially assembled elements therein with the tip of the tail block 312 projecting from rear end of the barrel 311, and the barrel 311 at front open end is releasably coupled with the rear end of the main body 1.

Figure 1:
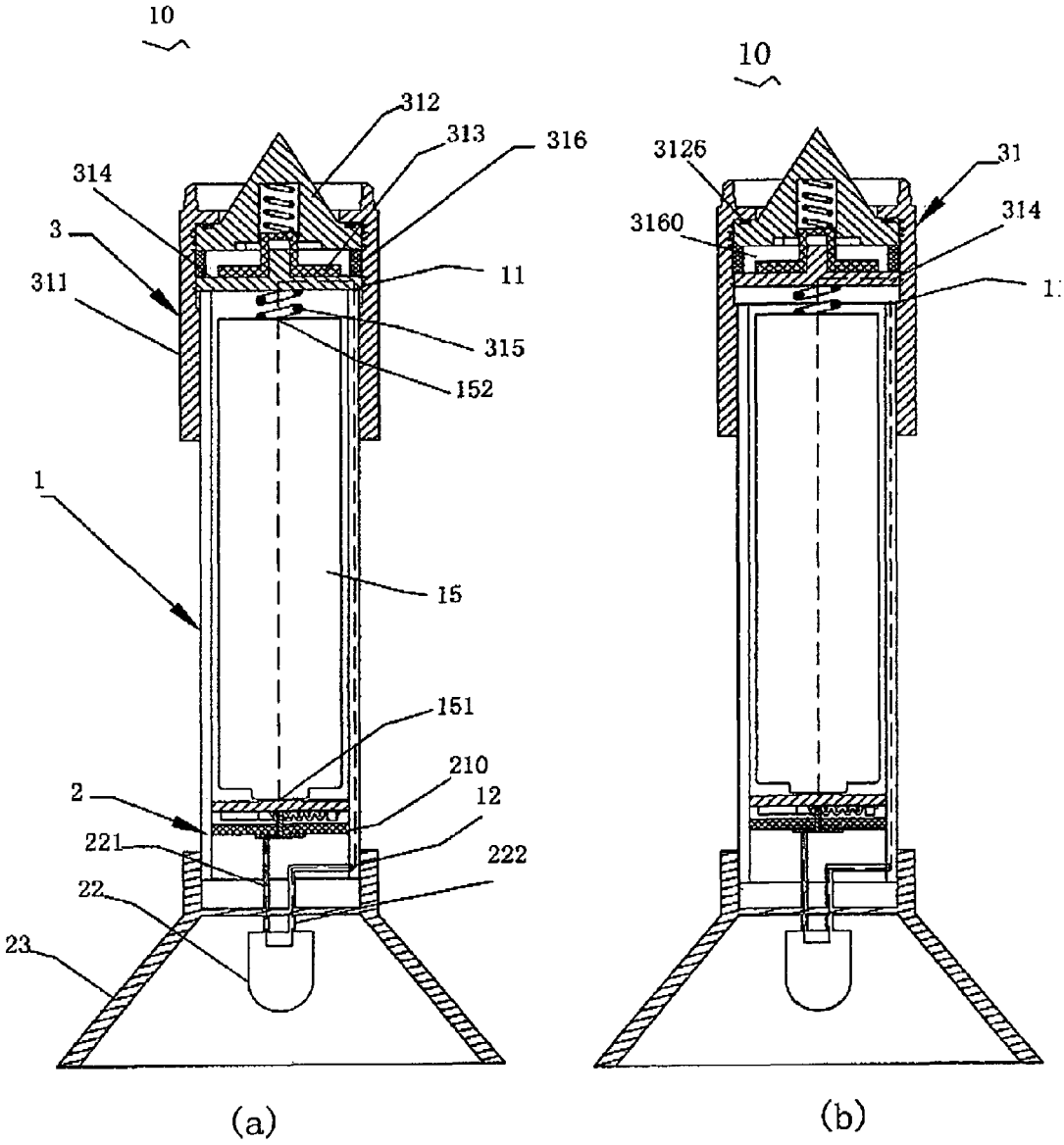
FIG. 1 is a sectional view of an electric torch in accordance with an embodiment of the present invention, wherein FIG. 1*a* and FIG. 1*b* respectively show the electric torch in electrical connection or disconnection.

It is understood that an O-ring 3126 may be desirably inserted between each two elements, for instance, between the tail block 312 and the rear end of the barrel 311 (as shown in FIG. 1), which will confirm the torch 10 with good waterproof. Furthermore, the tail block 312 may be integrally formed with the barrel 311.

The dashed lines in FIG. 1*a* depict the flow of current when the torch 10 is turned on for lighting. The electrical current goes from the positive terminal 151 of battery pack 15, through electrically conductive terminals 221, 222 and filament of the bulb 22, then from the conductive area 12 to the main body 1, and from the conductive area 11 of the main body 1 to the cathode plate 314 and the spring 315 to the negative terminal of the battery pack, thus forms a circuit to lighten the bulb 22. If lighting is not necessary, the torch is turned reverse, then the spring 315 is released, and the cathode plate 314 is moved rearward, which results in current disconnection between the cathode plate 314 and the conductive area 11 of the main body 1. The dashed lines in FIG. 1*b* depict the disconnection of the current flow, and the bulb is off.

The torch 10 of the present invention can also be used as an important tool in emergency situation, since it has a conic tip projecting from its rear end, which can be used to break the window of house or buses in fire. It is understood that an end cap (as an accessory) can be applied to cover the rear end of the torch 10 for shielding the conic tip from hurting users. And the tail block 312 can be configured as any other shape for various usages, such as a knife, key, or the like, which confers the torch 10 in various functions.

In another embodiment, referring to FIGS. 2-3 again, a magnetic control means 32 is removably supplied thereto when the torch 10 keeps off as shown in FIG. 1*b*. The magnetic control means 32 comprises an end cap 321, a magnet 322, a wire switch 323, and an electrically conductive ring 324.

The end cap 321, with a circular flange 3211 extending from inner bottom thereof, is made from non-conductive materials (such as plastic), or made from metal given non-conductive treatment. The magnet 322 with electrically conductive surface, is configured corresponding to the projecting portion of the tail block 312. In a preferable embodiment, the magnet 322 is constructed as a cylinder defining a conic cavity 3221 in the center for accommodating the projecting tip of the conic tail block 312. The ring 324 and the magnet 322 are mounted in the end cap 321 with the short circular flange 3211 being disposed therebetween so as to form an electrical insulation therebetween. The wire switch 323 is any adapted switch available in the art, and is electrically connected with both the magnet surface and the conductive ring 324 by conductive wires (not labeled).

When the magnetic control means 32 is assembled to the rear end of the torch 10 of FIG. 1*b*, the rear end of the tubular barrel 311 is inserted into the end cap 321 against the electrically conductive ring 324; and the projecting portion of the tail block 312 is fitted in the cavity 3221 in the magnet 322. As a result, the magnet 322 attracts the metal slider 313 moving to the tail block 312 until against the bottom face 3123 thereof, and the electrically conductive areas 3131, 3132 of the slider 313 respectively get contact with the cathode plate 314 and the electrically conductive area 3121 of the tail block 312. Therefore, the electric current is switched to flow through magnetic control means 32 and form a current circuit as shown with the dashed lines in FIG. 2. The current flows respectively from the positive terminal 151 of battery pack 15, terminals 221, 222 and filament of the bulb 22, the main body 1 with the conductive areas 11 and 12, the barrel 311 with the conductive areas 3111 and 3112, the conductive ring 324, 323 with wires, magnet 322, the block 312 with the conductive areas 3121 and 3122, the slider 313 with the conductive areas 3131 and 3132, the cathode plate 314, spring 315, and back to the negative terminal 152 of the battery pack 15, thus forms a circuit. Therefore, the bulb 22 is controlled on or off by the outer switch 323.

The additional switch 323 confers the torch 10 much more convenient and applicable in use. The tail block 312, the plastic ring 316, the o-ring 3126, and the cathode plate 314 seals the rear end of the torch 10, which presents the torch 10 with good waterproof. Furthermore, the electrical connection of the torch 10 will keep the electrically conductive areas 3131 and 3132 of the slider 313 respectively contact with the cathode plate 314 and the tail block 312. If the magnetic control means 32 is removed from the torch 10, the magnet's attractive force is removed, and then the slider 313 will leave the bottom 3123 of the tail block 312 and back to the cathode plate 314 by virtue of resilience force of the spring 317, which results in electrical disconnection between the slider 313 and the block 312. Furthermore, even in water, the torch 10 will not be wrongly lightened since it is impossible to form electrically connecting between interrupted conductive areas 3131 and 3121.

Figure 5:
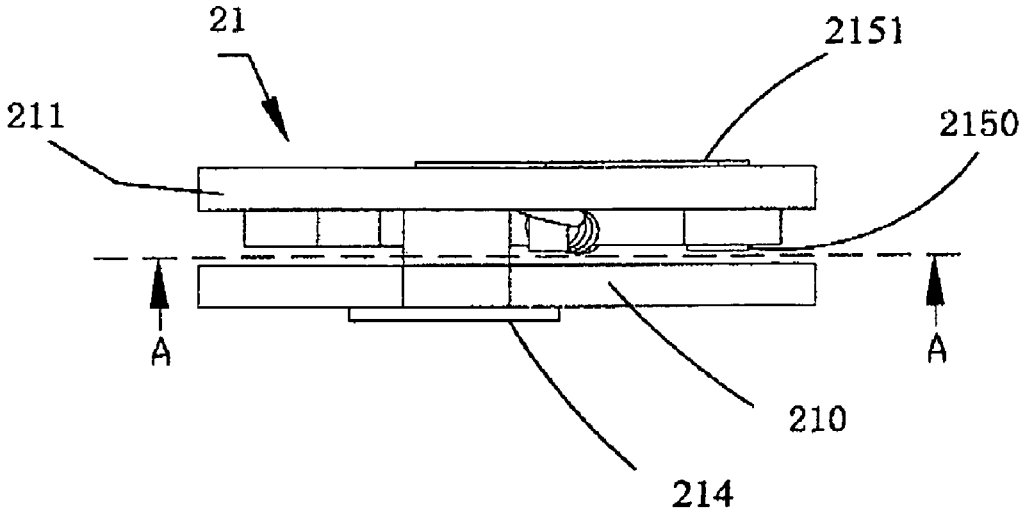
FIG. 5 is a side view of positive connecting means of the electric torch.
Figure 6:
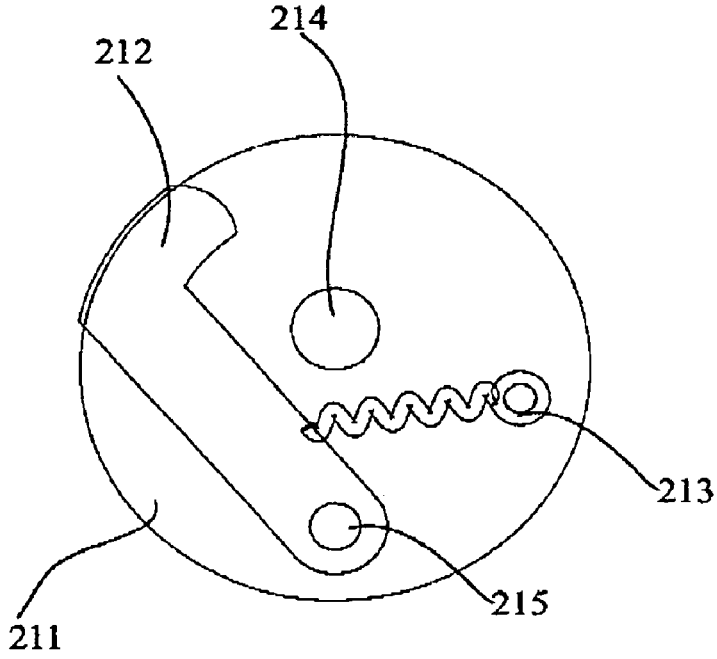
FIG. 6 is a top and sectional view of positive connecting means of FIG. 5 along Line A-A.

Preferably, further referring to FIGS. 4-6 together, the head assembly 2 of the torch 10 further comprises a positive connecting means 21, which is set between the positive terminal 151 of the battery pack 15 and the bulb 22 for forming electrical connection or disconnection therebetween. The positive connecting means 21 further comprises a socket 210, a circular back plate 211, a rotatable metal arm 212, an elastic member such as a spring 213, a metal connecting post 214, and a metal shaft 215. The socket 210 and back plate 211 are nonconductive which may be made from plastic, and are parallel mounted between the positive terminal 151 of the battery pack 15 and the bulb 22. The movable arm 212, the connecting post 214 and the shaft 215 are electrically conductive, and preferably made from (but not limited to) metal.

The metal connecting post 214 is inserted through the socket 210. One end of the post 214 extends from front face of the socket 210 to electrically connect with the terminal 221 of the bulb 22 (labeled in FIG. 1*a*), and the other end extends to front face of the back plate 211. The conductive shaft 215 comprises a pivot section 2150 and an extending plate 2151, which constructs the shaft 215 about in a shape of (but not limited to) L. The extending plate 2151 perpendicularly outgrows from an end of the pivot section 2150. The pivot section 2150 is inserted through back plate 211 with the end opposite to the extending plate 2151 rotatably fixing the arm 212 on the front face of the back plate 211, while the extending plate 2151 extends to the center of rear face of the back plate 211 for electrically connecting the positive terminal 151 of the battery pack 15. The movable arm 212 is configured in a shape of (but not limited to) L too in this embodiment. The spring 213 is mounted on the back plate 211 with one end thereof holding the movable arm 212. Therefore, the metal arm 212 is drawn to electrically contact with the metal connecting post 214.

With the assembly 2, when the torch 10 is turn on, the electrical current flows respectively from the positive terminal 151 of the battery pack 15, the extending plate 2151 and the pivot section 2150 of shaft 215, the movable arm 212, the metal connecting post 214, the bulb 22 with terminals 221 and 222, then as shown in FIG. 1*a* in dash lines and as aforesaid description, finally back to the negative terminal 152 of the battery pack 15, thus forms a circuit to lighten the bulb 22.

In a further embodiment, a recharging rack 4 is removably incorporated to the torch 10 for charging up the battery pack 15. The recharging rack 4 has two opposite seats: front seat 42 and rear seat 41. The main body 1 of the torch 10 is held between the two seats 41, 42. Herein, the rear seat 41 and the front seat 42 are respectively coupled with the rear end or the head of the main body 1. The rear seat 41 has the same structure as the magnetic control means 32 which includes an end cap 321, an electrically conductive ring 324 and a rear magnet 322, except that the wire switch 323 may be replaced as an adapter 43, a plug or the like for recharging. Herein it is unnecessary to go into details.

The front seat 42 has a front magnet 421 therein, which is coupled to the tubular main body 1 where the positive connecting means 21 is positioned. Therefore an attractive force of the front magnet 421 draws the rotatable arm 212 to deviate away from the connecting post 214, which results that the metal arm 212 electrically disconnects with the connecting post 214, but gets an electrically connected with the conductive area 13 of the main body 1 (as shown in FIG. 4).

When the adapter or plug 43 is connected with an outer power supply, the battery pack 15 will be recharged. The electrical current flows, depicted as dash lines in FIG. 4, respectively from the positive terminal 151 of the battery pack 15, the extending plate 2151 and the pivot section 2150 of shaft 215, the movable arm 212, the main body 1 with conductive areas 13 and 11, the barrel 311 with the conductive areas 3111 and 3112 (labeled in FIG. 2), the conductive ring 324, 43 with wires and outer power supply, magnet 322, the block 312 with the conductive areas 3121 and 3122, the slider 313 with the conductive areas 3131 and 3132, the cathode plate 314, spring 315, and back to the negative terminal 152 of the battery pack 15, thus forms a recharging circuit. But the bulb 22 is electrically disconnected.

It is understood that if the adapter 43 is replaced with other electric equipment, battery pack 15 of the torch 10 can be used as a power supply to recharge the electric equipment by the recharging rack 4.

The torch 10 can be easily released from the recharging rack 4, and is used for lighting or emergency tool as shown in FIG. 1.

Figure 7:
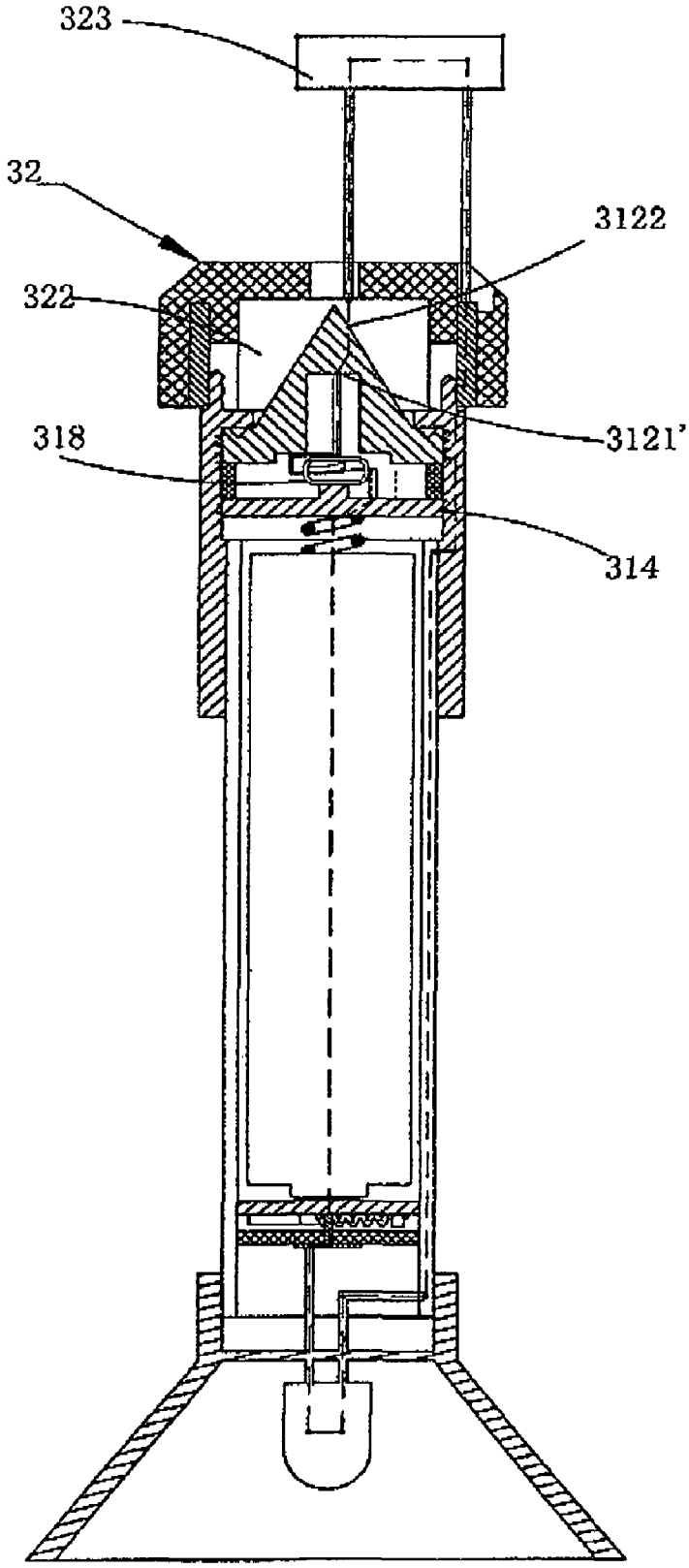
FIG. 7 is a sectional view of the electric torch in accordance with another embodiment.
Figure 8:
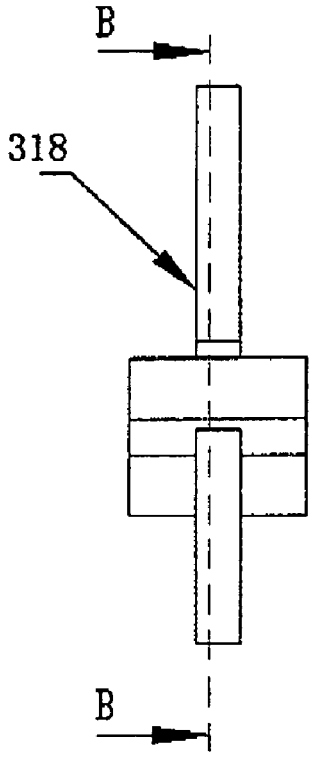
FIG. 8 is a front view of a magnetic contactor.
Figure 9:
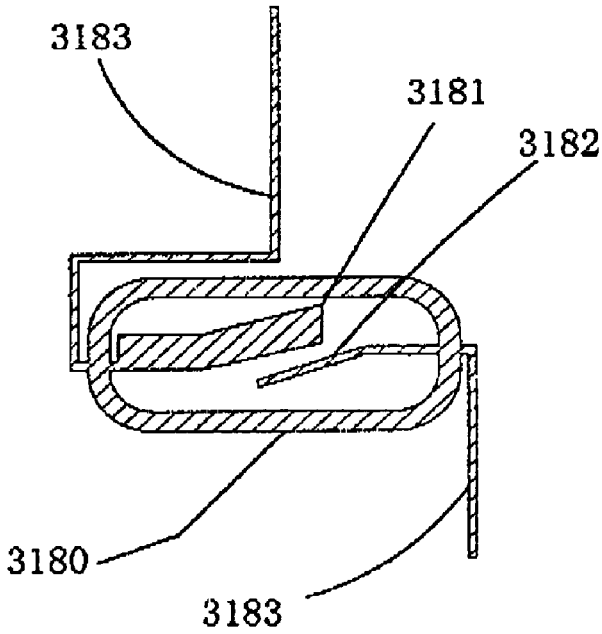
FIG. 9 is a sectional view of the magnetic contactor of FIG. 7 along Line B-B.

In another embodiment, referring to FIGS. 7-9 together, a magnetic contactor 318 is used to replace the metal slider 313 in the rear assembly 3. Hence, the spring 317 is not necessary in this embodiment. The contactor 318 comprises an electrically insulating housing 3180 for enclosing a pair of contacts therein: stationary contact 3181 and movable contact 3182. The pair of contacts are electrically conductive, which may be made from metal, and respectively electrically led out from the housing 3180 by electrical wires 3183. The pair of contacts 3181, 3182 will get electrically closed when an attractive force from a magnet draws the movable contact 3182 to touch the stationary contact 3181. When the magnet contactor 318 is assembled in the rear assembly 3, the stationary contact 3181 is electrically connected to the tail block 312 by virtue of the wire 3183 electrically connected with conductive area 3121' of the block 312, while the movable contact 3182 is electrically connected with the cathode plate 314 by the wire 3183, too.

When the magnetic control means 32 are assembled to the rear end of the torch 10, the movable contact 3182 moves from the open position (FIG. 9) to the closed position (FIG. 7) under an attractive force of the magnet 322 with a resulting path of current travel being through the contactor 318. The electric current flows, as depicted with dash lines in FIG. 7 and by comparison with FIG. 2, in difference with current flowing through the tail block 312 with conductive areas 3121' and 3122, to magnetic contactor 318 with wires 3183, then to cathode plate 314, and as such, from spring 315 and finally back to negative terminal 152 of battery pack 15, thus forms an electrical circuit. Therefore, the bulb 22 is controlled on or off by the outer switch 323.

When the magnetic control means 32 is removed from the torch 10, the attractive force of the magnet is removed accordingly, the movable contact 3182 leaves away the stationary contact 3181 and restores the open position. The torch 10 is controlled on or off as the same shown in FIG. 1*a* and FIG. 1*b*.

It is understood that the front assembly 2 can also use a magnetic contactor (not shown) to replace the movable metal arm 212, and the spring 213 is not necessary. The movable contact is electrically connected with the shaft 215 by wire, and the stationary contact is electrically connected with the conductive area 13 of main body 1. Herein, when the magnetic contactor is open, the movable contact electrically touches the metal connecting post 214 and then the electric current keeps in connection or disconnection as shown in FIG. 1*a* or FIG. 1*b*. But when the torch 10 is mounted in recharging rack 4, the front magnet 421 draws the movable contact away from the connecting post 214 to get closed to the stationary contact, therefore, the electrical circuit for recharging the battery pack is formed as shown in FIG. 4.

While the invention has been described in conjunction with specific embodiments, it is evident that numerous alternatives, modifications, and variations will be apparent to those skilled in the art in light of the forgoing descriptions. The scope of this invention is defined only by the following claims.

What is claimed is:

1. An electric torch comprising:

a main body accommodating battery pack therein;

a head assembly; and a rear assembly releasably engaged with a rear end of the main body;

wherein the rear assembly comprises a rear cover for enclosing an electrically conductive spring, an electrically conductive cathode plate, and a magnetic controlled member therein, and seals the rear end of the main body; the spring is electrically engaged between negative terminal of the battery pack and the cathode plate; the magnetic controlled member, which is disposed between the cathode plate and rear end of the rear cover, can divert electric current flows in the torch under an attractive force of a magnet; the main body is electrically conductive, and given an electrically nonconductive surface treatment except for certain areas for electrically connection; the rear cover comprises a barrel and a tail block; the rear assembly further comprises a nonconductive ring; the spring, the cathode plate, the magnetic controlled member, the ring and the tail block are respectively co-axially assembled together and accommodated in the barrel with the tail block partially projecting rearward from rear end of the barrel; the ring is inserted between the cathode plate and the tail block, which defines a passage for receiving the magnetic controlled member therein; the barrel and tail block are electrically conductive, and the barrel is given an electrically nonconductive surface treatment except for certain areas for electrically connection.

2. The electric torch according to claim 1, wherein the tail block substantially has a shape of cone with tip thereof extending from rear end of the barrel.

3. The electric torch according to claim 1, wherein the magnetic controlled member is a metal slider which is given nonconductive surface treatment except for certain areas for electrically connection; when an attractive force from a magnet draws the slider moving to the tail block, an electrical bridge connection between the cathode plate and the tail block is available through the slider.

4. The electric torch according to claim 3, wherein said tail block is hollow in center and accommodating a spring therein so as to guide the slider moving therein; the slider is hollow in center therein for receiving an extending rod of the cathode plate; and the electrically-conducting spring is engaged with the cathode plate opposite to the rod.

5. The electric torch according to claim 4, wherein the slider substantially comprises a circular plate and a post extending from center thereof; the post extends into hollow center of the tail block and gets engaged with the spring therein.

6. The electric torch according to claim 1, wherein the magnetic controlled member is a magnetic contactor, which comprises a pair of contacts: stationary contact and a movable contact; the pair of contacts are respectively electrically connected with the tail block and the cathode plate through wires; when an attractive force from a magnet draws the movable contact closed to the stationary contact, an electrical bridge connection between the cathode plate and the tail block is available through the contactor.

7. The electric torch according to claim 1, further comprising a magnetic control means removably and electrically coupled to the rear assembly of the torch, wherein the magnetic control means comprises a rear magnet electrically coupled to the projecting part of the tail block from the rear end of the barrel, thereby an attractive force is exerted to the magnetic controlled member to obtain an electrical bridge connection between the cathode plate and the tail block.

8. The electric torch according to claim 7, wherein the magnetic control means further comprises an end cap, an electrically-conducting ring, and an out switch; the electrically-conducting ring and the rear magnet are fixed in the end cap with electrical insulation therebetween; the rear magnet has electrically conductive surfaces; and the outer switch is respectively electrically connected with the rear magnet and the electrically-conducting ring with wires.

9. The electric torch according to claim 1, wherein the head assembly comprises a bulb with two terminals extending therefrom and a positive connecting means for electrically connecting or disconnecting between positive terminal of the battery pack and the bulb.

10. The electric torch according to claim 9, wherein the positive connecting means comprises a back plate, a socket, a metal shaft, a metal connecting post, and a current diverting means to divert electrical current in the head assembly; wherein the back plate and the socket are electrically insulating and mounted in head portion of the barrel; the metal shaft is inserted through the back plate with one end electrically connecting with the diverting means and the other end extending to electrically connect with positive terminal of the battery pack; the metal connecting post is mounted in the socket with one end thereof electrically connected with the terminal of the bulb; the diverting means is electrically connected with both the metal shaft and the other end of the connecting post in first position, and diverted to electrically connect with both the metal shaft and the main body under an attractive force of a magnet in a second position.

11. The electric torch according to claim 10, wherein the diverting means is a movable metal arm, which is pivotally fixed on the back plate by the metal shaft; a spring is mounted on the back plate with one end grasping the movable metal arm to electrically contact with the metal connecting post in the first position; thereby electric current flows from positive terminal of battery pack, to the metal shaft, the movable metal arm, the metal connecting post, and then to the bulb; and when a magnet draws the movable arm to leave the connecting post and electrically contact with main body, the electric current will be diverted to flow from the metal arm to the main body instead of to the connecting post and the bulb in the second position.

12. The electric torch according to claim 10, wherein the diverting means is a magnetic contactor which comprises a stationary contact and a movable contact; the stationary contact is electrically connected with the main body, and the movable contact is electrically connected with the shaft; in the first position, the movable contact electrically touch the metal connecting post, which results that electric current flows from positive terminal of battery pack, to the metal shaft, the movable contact, the metal connecting post, and then to the bulb; and when a magnet draws the movable contact to leave the connecting post and get closed to the stationary contact, the electric current will be diverted to flow from the metal arm to the main body instead of to the connecting post and the bulb in the second position.

13. The electric torch according to claim 10, further comprising a removable recharging rack for holding the electric torch thereon, wherein the recharging rack has two opposite seats: front seat and rear seat; the front seat has a front magnet coupled to the head assembly corresponding to the positive connecting means, and the rear seat has a rear magnet coupled to the rear assembly of the torch; thereby the current will be diverted to flow from positive terminal of battery pack, to the positive connecting means, the main body, the rear seat, and the rear assembly then back to negative terminal of battery pack and form an electric current for recharging.

14. The electric torch according to claim 13, wherein an adapter or a plug is connected with the rear seat by wires so that the recharging rack can be used to recharge the battery pack in the electric torch from an outer power supply; or another electric equipment is connected with the rear seat by wires so that the electric torch can be used as a power supply to recharge another electric equipment.

15. The electric torch according to claim 14, wherein the rear seat further comprises an end cap and an electrically-conducting ring; the electrically-conducting ring and the rear magnet are fixed in the end cap with electrical insulation therebetween; the rear magnet with electrically conductive surfaces, is electrically coupled to the projecting part of the tail block from the rear end of the barrel; and the outer adapter, plug or another electric equipment is electrically connected with both the rear magnet and the electrically-conducting ring with wires.

16. An electric torch comprising a rear assembly, a main body, a head assembly, and a magnetic control means removably and electrically coupled to the rear assembly, wherein the rear assembly comprises a magnetic controlled member; the magnetic control means has a rear part, which comprises a rear magnet electrically engaged with the magnetic controlled member; thereby electric current in the torch will be diverted to flow from positive terminal of battery pack, bulb, main body, through the magnetic control means and the magnetic controlled member, and then back to negative terminal of battery pack; the head assembly further comprises a current diverting means, the magnetic control means further comprises a front part which has a front magnet coupled to the current diverting means, thereby electric current from positive terminal of battery pack will be controlled not to flow through bulb but directly to the main body and then from the rear part of the magnetic control means to the magnetic controlled member, and finally back to negative terminal of battery pack.

17. The electric torch according to claim 16, wherein the rear part of the magnetic control means electrically connects with an outer switch for controlling the torch on or off, or an adapter or plug for recharging the battery of the torch by wires.

* * * * *